US007788764B2

(12) United States Patent
Cobb, Jr.

(10) Patent No.: US 7,788,764 B2
(45) Date of Patent: Sep. 7, 2010

(54) PORTABLE SUCTION DEVICE FOR CLEANING JOBS

(75) Inventor: William T Cobb, Jr., St. Petersburg, FL (US)

(73) Assignee: EMAK S.p.A., Bagnolo In Piano (Reggio Emilia) (IT)

( * ) Notice: Subject to any disclaimer, the term of this patent is extended or adjusted under 35 U.S.C. 154(b) by 325 days.

(21) Appl. No.: 11/434,926

(22) Filed: May 17, 2006

(65) Prior Publication Data

US 2006/0265833 A1 Nov. 30, 2006

(30) Foreign Application Priority Data

May 26, 2005 (IT) ..... RE2005A0060

(51) Int. Cl.
*A47L 5/24* (2006.01)

(52) U.S. Cl. ..... 15/344; 15/330; 15/345; 415/98; 415/99

(58) Field of Classification Search ..... 15/344, 15/345, 330; 415/98, 99
See application file for complete search history.

(56) References Cited

U.S. PATENT DOCUMENTS 2,982,986 A * 5/1961 Tupper ..... 15/327.6
6,059,541 A * 5/2000 Beckey et al. ..... 417/295
6,386,839 B1 5/2002 Chuang
6,442,790 B1 * 9/2002 Svoboda et al. ..... 15/330
6,736,610 B2 * 5/2004 Cifarelli ..... 417/366
6,835,051 B2 * 12/2004 Heim et al. ..... 417/423.7
2005/0095125 A1 5/2005 Chang

FOREIGN PATENT DOCUMENTS

DE 199 46 187 A1 6/2000
EP 0 198 654 A 10/1986
EP 0 890 745 A 1/1999

* cited by examiner

*Primary Examiner*—Shay Karls
(74) *Attorney, Agent, or Firm*—Browdy and Neimark, PLLC

(57) ABSTRACT

A suction device for cleaning jobs comprising a bladed impeller (1) actuated by a motor and suitable for being housed inside a carcass provided with an inlet opening for an airflow and an outlet opening, where said impeller (1) comprises a first series of blades (2) and a second series of blades (3), which rotate firmly fixed together, coaxial to each other and distributed in a staggered manner, suitable for respectively generating an axial flow and a radial flow, said second series of blades (3) being arranged downstream of the first series of blades (2), with respect to the inlet opening, so that the air sucked in is transmitted from the first series of blades (2) to the second series of blades (3) before it reaches the outlet opening.

15 Claims, 3 Drawing Sheets

PORTABLE SUCTION DEVICE FOR CLEANING JOBS

BACKGROUND OF THE INVENTION

1. Technical Field of the Invention

The present invention refers to a portable suction device for cleaning jobs.

More specifically, the present invention refers to a portable suction device suitable for sucking up sawdust, leaves, grass cuttings and similar for cleaning jobs at rural and/or urban locations.

2. Prior Art

As known, common portable suction devices comprise an impeller with centrally closed disc fitted on a drive shaft suitable for making it rotate inside a closed housing provided with an air inlet opening with which a suction mouth is associated and an outlet opening with which a collection sack is associated.

Portable suction devices of the prior art comprise an impeller having a plurality of blades with radial flow arranged close together so as to generate a sufficient static flow to overcome the load loss due to the collection sack for the material that has been sucked up. These blades inevitably have an unsuitable attachment angle near to the suction opening where the predominant flow direction is axial to the impeller, whereas the motion of the blades is in a tangential direction. This means low efficiency and lots of noise during use.

Therefore, there is a great need to have a suction device for cleaning jobs that has high efficiency and that produces little noise.

Object of the Invention

The purpose of the present invention is that of providing a suction device having structural and functional characteristics such as to satisfy the aforementioned requirements and at the same time to avoid the aforementioned drawbacks with reference to the prior art.

BRIEF DESCRIPTION OF THE DRAWINGS

Further characteristics and advantages of the invention shall become clear from reading the following description provided as an example and not for limiting purposes, with the help of the figures illustrated in the attached tables, in which.

DETAILED DESCRIPTION OF THE PREFERRED EMBODIMENT OF THE INVENTION

Figure 1:
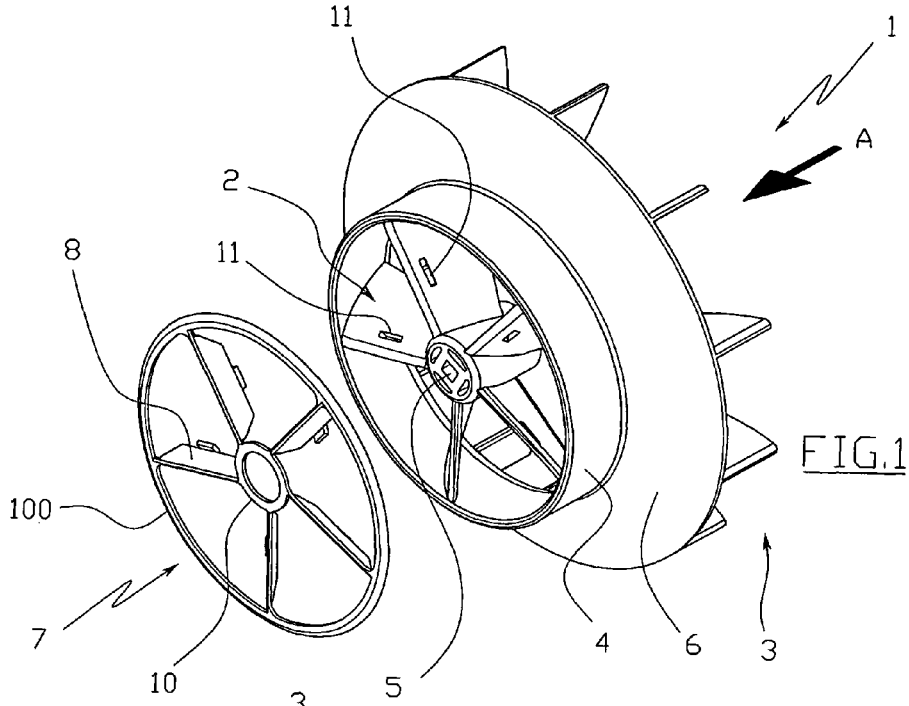
FIG. 1 shows a perspective view of an impeller and respective blade guard of a suction device, in accordance with the present invention.
Figure 6:
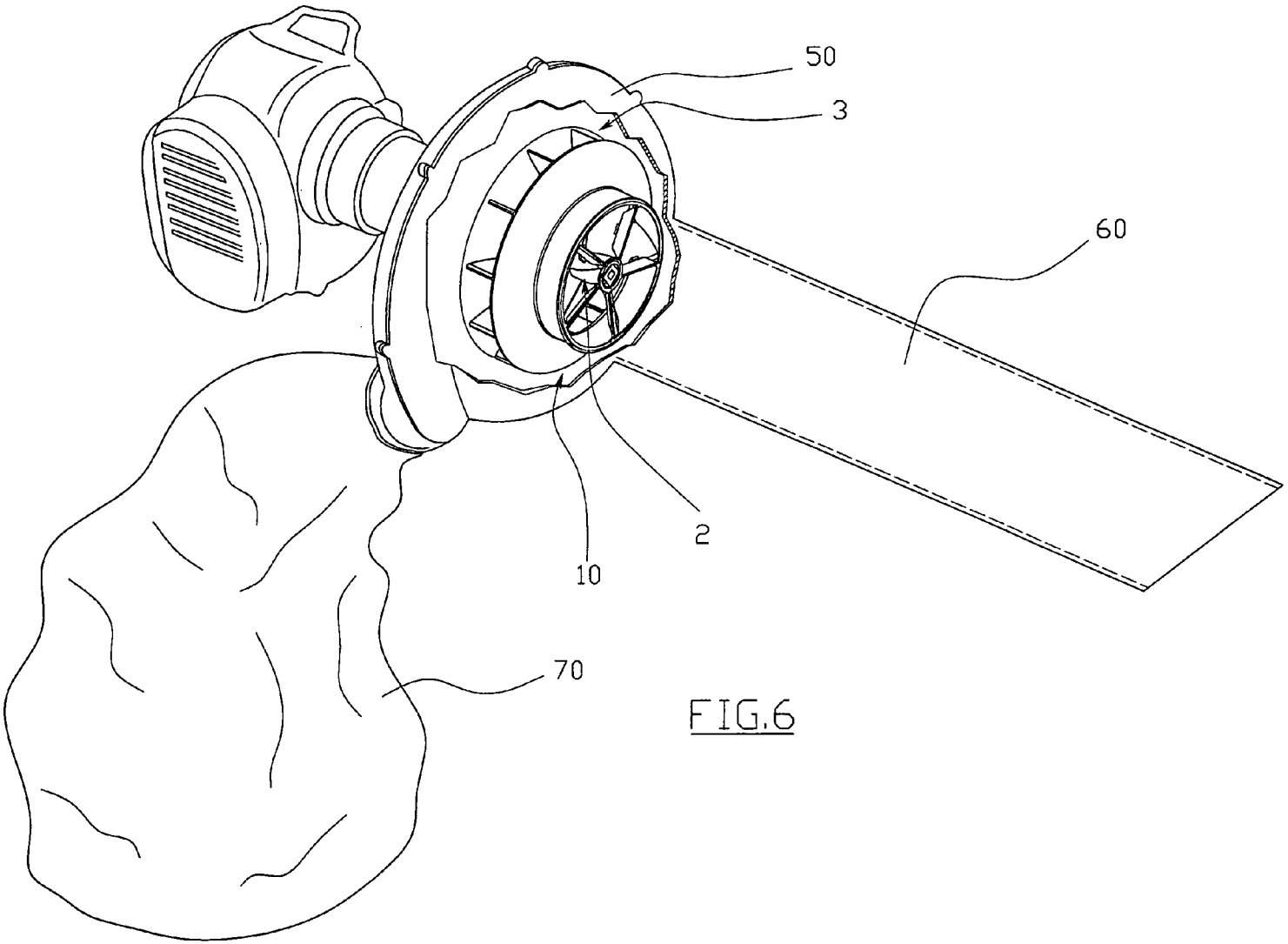
FIG. 6 shows a perspective view, partially in section, of the overall suction device.

With reference to FIG. 1, an impeller for a suction device (FIG. 6) in accordance with the present invention is globally indicated with 1.

The suction device in brief comprises an impeller 1, a motor for actuating the impeller 1 that is fitted centrally to the drive shaft, a carcass 50 (FIG. 6) for containing the impeller 1 provided with an inlet opening with which a suction mouth 60 is associated and an outlet opening with which a collection sack 70 is associated.

In accordance with the present invention, the impeller 1 comprises a first series of blades, globally indicated with 2, and a second series of blades, globally indicated with 3, coaxial to each other and distributed in a staggered manner. The first series of blades 2 is suitable for generating an axial flow whereas the second series of blades 3 is suitable for generating a radial flow. The second series of blades 3 is arranged downstream of the first series of blades 2, with respect to the inlet opening, i.e. with respect to the side of attachment of the suction mouth.

Basically, the arrangement of the blade sets 2 and 3 is selected so that the air sucked in reaches first the first series of blades 2 that transmits it to the second series of blades 3 before it reaches the outlet opening and then the collection sack 70.

In particular, the impeller 1 comprises a hollow cylindrical body 4 inside which the first series of blades 2 is formed, said blades projecting from a common central hub 5, suitable for being fitted onto the drive shaft. Outside the cylindrical body 4 a circular crown 6 carrying the second series of blades 3 is coaxially fixed, said blades being staggered with respect to those of the first series 2.

In accordance with the preferred embodiment of the present invention, the circular crown 6 has a frusto-conical configuration with the smaller base fixed firmly to the edge of the cylindrical body 4.

In order to improve the yield and further decrease the noise during use, the airflow is "helped" in the passage from axial motion to radial motion, i.e. in the passage from the first series of blades 2 to the second series of blades 3 by making the surface of the circular crown 6 with a curvature having the concavity facing outwards.

The blades of the second series of blades 3 are arranged on the surface of the circular crown 6 opposite that for the inlet of the airflow, i.e. on the convex side.

As can be seen from the figures, the number of blades in the first series of blades 2 is less than in the second series of blades 3; in the example the first series of blades 2 consists of four blades, whereas the second series of blades 3 consists of eleven blades.

Figure 2:
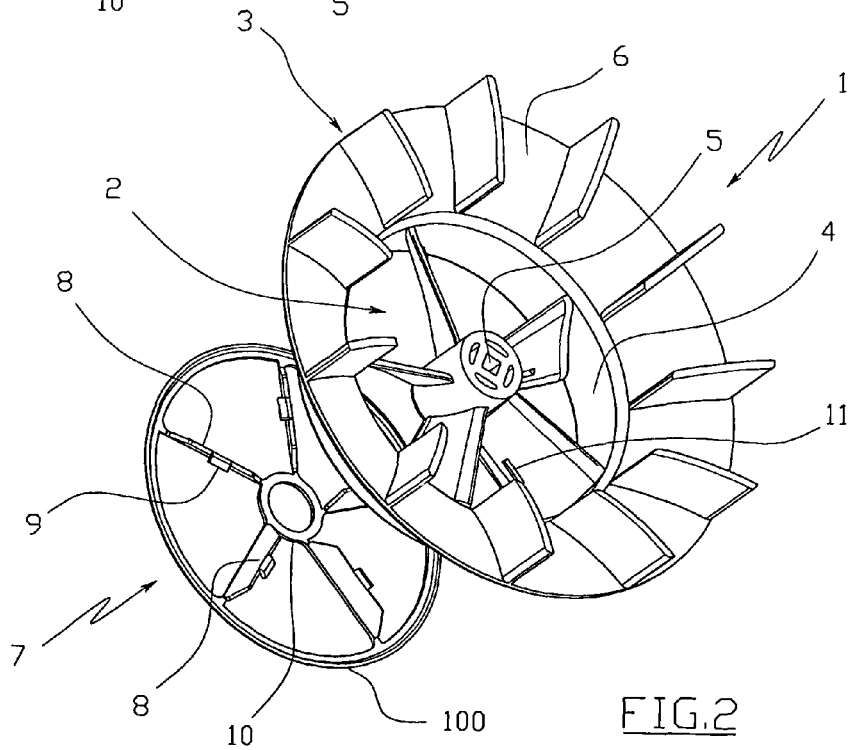
FIG. 2 shows a perspective view of the impeller seen from the arrow A of FIG. 1.
Figure 3:
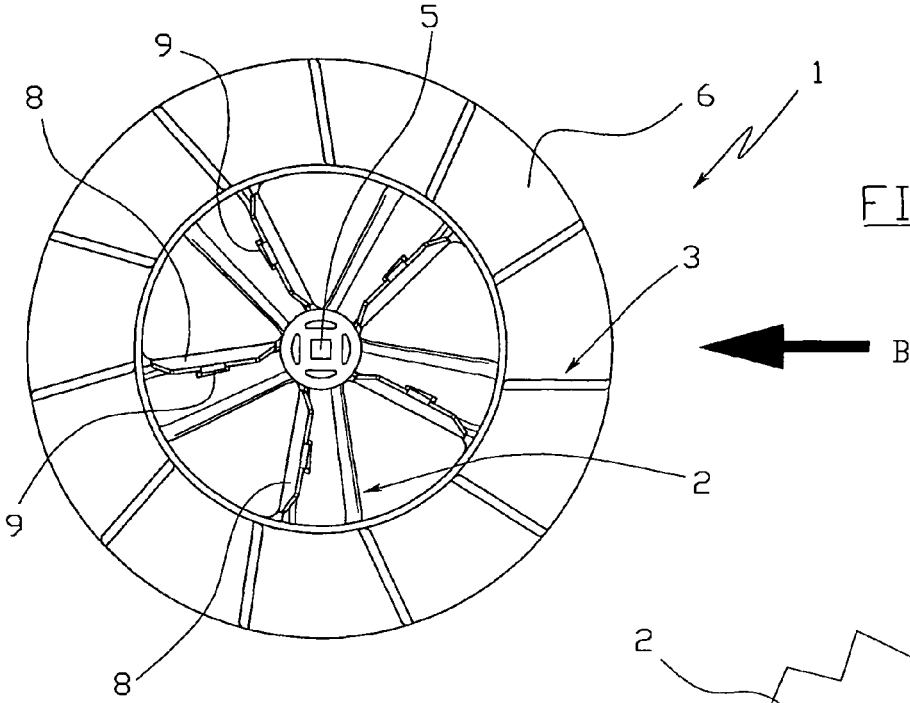
FIG. 3 shows a plan view of the impeller seen from the arrow A of FIG. 1.
Figure 4:
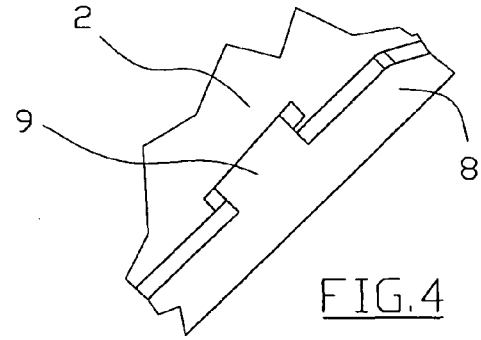
FIG. 4 shows a detail of FIG. 3.
Figure 5:
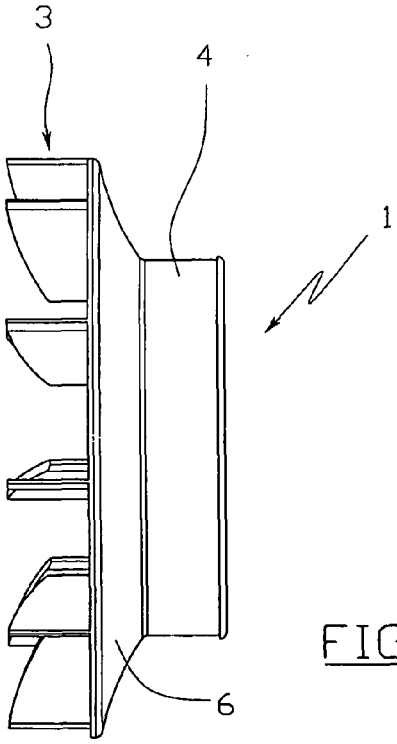
FIG. 5 shows a side view of the impeller seen from the arrow B of FIG. 3.

The particular configuration of the blades is selected according to the intended use of the suction device and according to current knowledge in the field. Specifically, each of the blades of the first series of blades 2 are generally flat and extend axially at an angle relative to the rotation axis of the drive shaft as can be seen in FIGS. 1 and 2 to provide the intended axial air flow.

The impeller 1 of the present invention can be easily obtained through known plastic forming processes.

Since during usual suction operations it is possible that debris may be sucked up that can damage the inlet edge of the blades of the first series 2, it is foreseen to use a blade guard 7, made from metal, provided with protective elements 8 suitable for engaging with the respective blades of the first series of blades 2 so as to screen their inlet edge.

Each protective element 8 is in the form of a pair of concentric circular rings 10, 100 with the protective elements 8 fanning out between them.

The inner ring 10 is suitable for cooperating in engagement with the hub 5 and the outer ring 100 is suitable for cooperating in engagement with the edge of the circular body 4.

Each protective element 8 is provided with an appendix 9 suitable for snap-engaging in a corresponding slot 11 formed on each blade of the first series of blades 2.

As can be appreciated from what has been described, the suction device according to the present invention allows the requirements to be satisfied and allows the drawbacks mentioned in the introductory part of the present description with reference to the prior art to be overcome.

Of course, a man skilled in the art can bring numerous modifications and variants to the suction device described above in order to satisfy contingent and specific requirements, all of which are covered by the scope of protection of the invention, as defined by the following claims.

The invention claimed is:

1. Suction device for cleaning jobs comprising:

a bladed impeller (1) actuated by a motor and housed inside a carcass (50), said carcass (50) provided with only one inlet opening for an airflow and only one outlet opening, wherein said impeller (1) comprises a first series of blades (2) and a second series of blades (3), which rotate about a rotation axis and are firmly fixed together, coaxial to each other and distributed in a staggered manner, the first series of blades being generally flat and extending axially at an angle relative to the rotation axis for generating an axial flow directed to the centre of the second series of blades, and the second series of blades generating a radial flow, said second series of blades (3) being arranged downstream of the first series of blades (2), with respect to the only one inlet opening, so that all the air sucked in is transmitted from the first series of blades (2) to the second series of blades (3) through a space therebetween before it reaches the only one outlet opening.

2. Suction device according to claim 1, in which said impeller (1) comprises a circular hollow cylindrical body (4) radially inside of which said first series of blades (2) is substantially fully fixedly arranged and circumferentially enclosed, said first series of blades (2) project from a central hub (5), and an outer circular crown (6) fixed to said cylindrical body and provided with said second series of blades (3).

3. Suction device according to claim 2, in which said circular crown (6) has a frusto-conical configuration with the smaller base associated with the cylindrical body (4).

4. Suction device according to claim 3, in which the surface of said circular crown (6) has a curvature with concavity facing towards the inlet opening for the airflow.

5. Suction device according to claim 3, in which the blades of said second series of blades (3) are arranged on the surface of the circular crown (6) opposite the one for the inlet of the airflow.

6. Suction device according to claim 1, in which the number of blades in the first series of blades (2) is less than the number of blades in the second series of blades (3).

7. Suction device according to claim 1, furthermore comprising a blade-guard (7) provided with protective elements (8) suitable for engaging with the respective blades of the first series of blades (2) so as to screen their inlet edge.

8. Suction device according to claim 7, in which each protective element (8) is provided with an appendix (9) suitable for snap-engaging in a corresponding slot (11) formed on each blade of the first series of blades (2).

9. Suction device according to claim 1, in which said impeller (1) is made from plastic.

10. Suction device according to claim 1, in which a suction mouth (60) is fitted onto said inlet opening and a collection sack (70) is fitted onto said outlet opening.

11. Suction device for cleaning jobs comprising:

a bladed impeller (1) actuated by a motor and housed inside a carcass (50), said carcass (50) provided with only one inlet opening for an airflow and only one outlet opening, wherein said impeller (1) comprises a first series of blades (2) and a second series of blades (3), which rotate firmly fixed together, coaxial to each other and distributed in a staggered manner, the first series of blades generating an axial flow directed to the centre of the second series of blades and the second series of blades generating a radial flow, said second series of blades (3) being arranged downstream of the first series of blades (2), with respect to the only one inlet opening, so that all the air sucked in is transmitted from the first series of blades (2) to the second series of blades (3) through a space therebetween before it reaches the only one outlet opening, in which said impeller (1) comprises a circular hollow cylindrical body (4) inside of which said first series of blades (2) is fixedly arranged that projects from a central hub (5), and an outer circular crown (6) fixed to said cylindrical body and provided with said second series of blades (3), and in which said circular crown (6) has a frusto-conical configuration with the smaller base associated with the cylindrical body (4).

12. Suction device according to claim 11, in which the surface of said circular crown (6) has a curvature with concavity facing towards the inlet opening for the airflow.

13. Suction device according to claim 11, in which the blades of said second series of blades (3) are arranged on the surface of the circular crown (6) opposite the one for the inlet of the airflow.

14. Suction device for cleaning jobs comprising:

a bladed impeller (1) actuated by a motor and housed inside a carcass (50), said carcass (50) provided with only one inlet opening for an airflow and only one outlet opening, wherein said impeller (1) comprises a first series of blades (2) and a second series of blades (3), which rotate firmly fixed together, coaxial to each other and distributed in a staggered manner, the first series of blades generating an axial flow directed to the centre of the second series of blades, and the second series of blades generating a radial flow, said second series of blades (3) being arranged downstream of the first series of blades (2), with respect to the only one inlet opening, so that all the air sucked in is transmitted from the first series of blades (2) to the second series of blades (3) through a space therebetween before it reaches the only one outlet opening, and further comprising a blade-guard (7) provided with protective elements (8) suitable for engaging with the respective blades of the first series of blades (2) so as to screen their inlet edge.

15. Suction device according to claim 14, in which each protective element (8) is provided with an appendix (9) suitable for snap-engaging in a corresponding slot (11) formed on each blade of the first series of blades (2).

* * * * *